US005125476A

United States Patent [19]

Merrick

[11] Patent Number: 5,125,476

[45] Date of Patent: Jun. 30, 1992

[54] LADDER APPARATUS AND HINGE SYSTEM THEREFOR

[76] Inventor: Harry G. Merrick, N. 31910 Pend O'Reille Rd., Chattaroy, Wash. 99003

[21] Appl. No.: 760,885

[22] Filed: Sep. 16, 1991

[51] Int. Cl.[5] ..... E06C 9/12

[52] U.S. Cl. ..... 182/97; 182/100; 182/106; 182/189

[58] Field of Search ..... 182/97, 93, 100, 106, 182/189

[56] References Cited

U.S. PATENT DOCUMENTS

| | | | |
|---|---|---|---|
| 907,401 | 12/1908 | Prouty . | |
| 1,116,829 | 11/1914 | McCoy . | |
| 1,141,716 | 6/1915 | Kjellstrom | 182/97 |
| 3,019,851 | 2/1962 | Doss | 182/111 |
| 3,313,374 | 4/1967 | Teach | 182/97 |
| 4,037,686 | 7/1977 | Shull | 182/97 |
| 4,106,591 | 8/1978 | Cohen et al. | 182/93 |
| 4,807,719 | 2/1989 | Burkstrand | 182/97 |
| 4,981,195 | 1/1991 | Merrick | 182/100 |

FOREIGN PATENT DOCUMENTS 1000490 10/1951 France .

*Primary Examiner*—Reinaldo P. Machado
*Attorney, Agent, or Firm*—Wells, St. John & Roberts

[57] ABSTRACT

A ladder apparatus comprising a longitudinally elongated step support for mounting between an upper level and a lower level at a forward angle of inclination. The elongated support has an upper end and a lower end. A series of steps are mounted relative to the elongated support. A hinge assembly is mounted relative to the elongated support adjacent its upper end. The hinge assembly includes a pivot positioned adjacent one of the outer longitudinal edges enabling the ladder apparatus to be swung at least about 90° between an operable position and a stowed position. The hinge assembly preferably comprises retaining means for inhibiting the ladder apparatus from swinging away from the operable position.

39 Claims, 4 Drawing Sheets

12
50
38
30
26b
22
52
28
32
18a
26a
11
10
26b
16
18b
20
26a
26b
18c
26a
26b
18d
26a
26b
14
24

36
28
34
12
38
32
30
50
52
22
26a
26b
16
10
26b
26a
20
26b
26a
11
26b
26a
14
26b
24

LADDER APPARATUS AND HINGE SYSTEM THEREFOR

TECHNICAL FIELD

This invention relates to ladders for substantially permanent mounting between an upper level and a lower level at a forward angle of inclination.

BACKGROUND OF THE INVENTION

Ladders are convenient for climbing or descending from one elevation to another. One example of a ladder apparatus adapted for generally permanent mounting is illustrated in my U.S. Pat. No. 4,981,195. FIG. 6 of such patent illustrates a hinge mounting system for the apparatus enabling it to be pivoted to an angle relative to the wall. It will be apparent however that such an apparatus cannot be pivoted to be flush against the wall as the uppermost stair will contact the wall preventing further pivoting. It would be desirable to develop improved ladders which can be pivoted further out of the way when not in use.

BRIEF DESCRIPTION OF THE DRAWINGS

Preferred embodiments of the invention are described below with reference to the accompanying drawings.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

In accordance with one aspect of the invention, a ladder apparatus comprises:

a longitudinally elongated step support for mounting between an upper level and a lower level at a forward angle of inclination, with the elongated support having an upper end and a lower end;

a series of steps mounted relative to the elongated support;

the ladder apparatus having opposing outer longitudinal edges; and a hinge assembly mounted relative to the elongated support adjacent its upper end, the hinge assembly including a pivot positioned adjacent one of the outer longitudinal edges enabling the ladder apparatus to be swung at least about 90° between an operable position and a stowed position. The hinge assembly preferably comprises retaining means for inhibiting the ladder apparatus from swinging away from the operable position.

In accordance with another aspect of the invention, an alternating tread ladder apparatus comprises:

a central longitudinally elongated tread support for mounting between an upper level and a lower level at a forward angle of inclination, the elongated support having an upper end and a lower end, and having opposing sides;

a series of alternating tread steps mounted relative to the opposing sides of the elongated central support, the tread steps at least in part defining opposing outer longitudinal ladder apparatus edges; and a hinge assembly mounted relative to the elongated support adjacent its upper end, the hinge assembly including a pivot positioned adjacent one of the outer longitudinal edges enabling the ladder apparatus to be swung at least about 90° between an operable position and a stowed position.

The invention further comprises the hinge assembly incorporated in the above described ladder apparatus.

Figure 1:
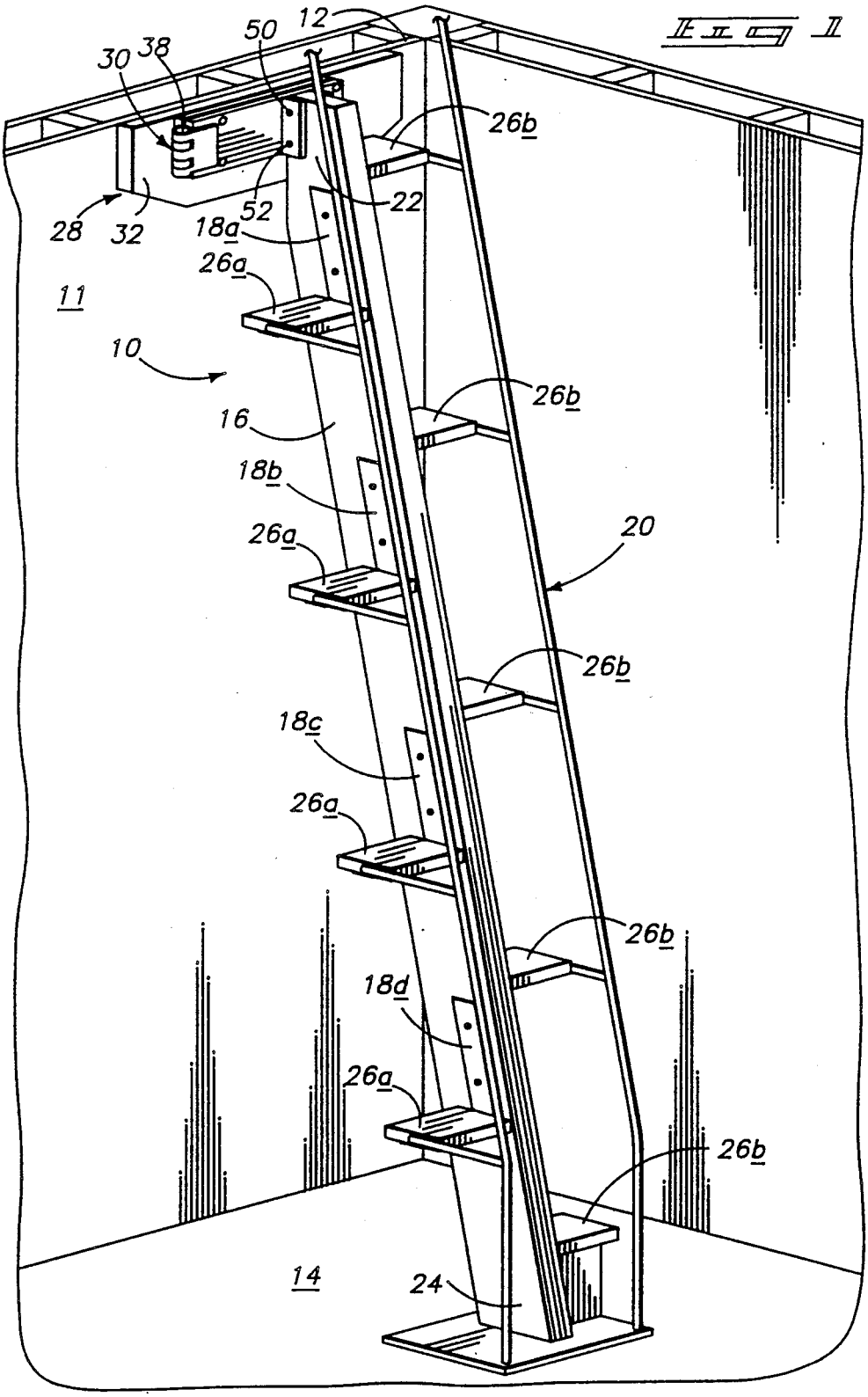
FIG. 1 is a perspective view of a ladder apparatus in accordance with the invention shown in an operable position.
Figure 2:
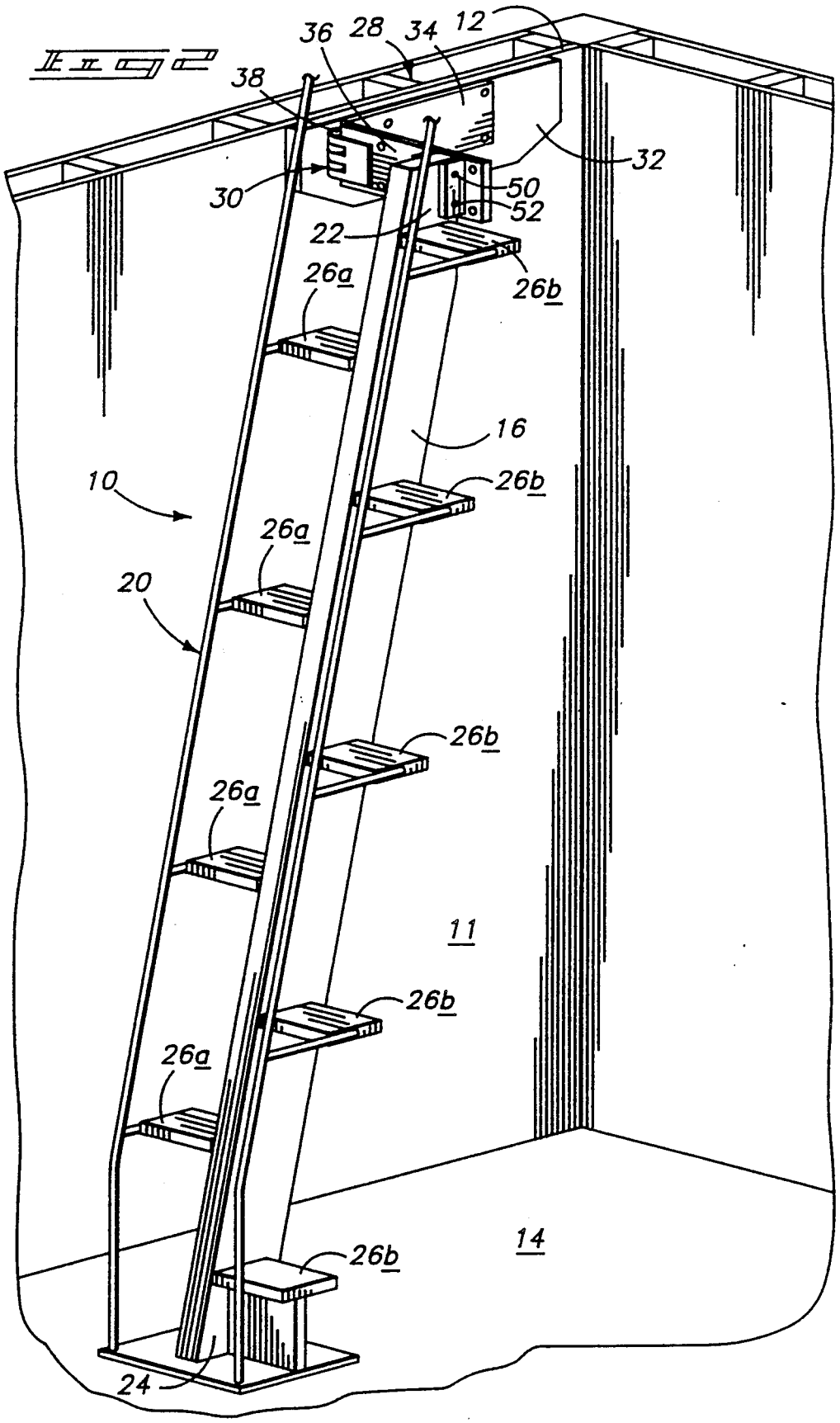
FIG. 2 is a perspective view of the FIG. 1 ladder apparatus shown in a stowed position.

Referring to FIGS. 1 and 2, a ladder apparatus in accordance with the invention is indicated generally by reference number 10. Apparatus 10 is shown mounted against or relative to a wall 11 and extends generally between an upper floor level 12 and a lower floor level 14 at some predetermined forward angle of inclination. This enables alternating tread ladder apparatus 10 to take up less space than is normally required by a conventional staircase. In accordance with the invention, the preferred angle of inclination is approximately equal to 18° from vertical, as disclosed in my U.S. Pat. No. 4,981,195.

Ladder apparatus 10 as shown is comprised of: (a) a single elongated central support or stringer 16 which mounts between upper level 12 and lower level 14 at the predetermined angle of inclination, (b) a plurality of tread step bracket means **18*a*, 18*b*, 18*c* and 18*d* mounted to central tread support 16 for supporting the weight of a person using ladder apparatus 10, and (c) a handle/-guide system 20. Tread support 16 has opposed ends 22 and 24**.

The tread step bracket means and central support 16 are as described in my U.S. Pat. No. 4,981,195, which is hereby incorporated-by-reference as if fully included herein. This invention however is only limited by the accompanying claims appropriately interpreted in accordance with the doctrine of equivalents. Tread step bracket means **18*a*, 18*b*, 18*c* and 18*d* define a series of alternating tread steps 26*a* and 26*b* mounted relative to opposing sides of elongated central support 16. Handle system 20, in the form of a pair of bent and fingered metal rods as shown, engages with the outer edges of tread steps 26*a* and 26*b*. Such would typically be attached to the respective tread steps 26*a* and 26*b* by a pair of screws (not shown). Tread steps 26*a* and 26*b* in combination with railing system 20 define opposing outer longitudinal ladder apparatus edges extending between upper level 12 and lower level 14**.

A hinge assembly 28 is mounted relative to elongated support 16 adjacent its upper end 22. Hinge assembly 28 includes a pivot joint 30 positioned adjacent one of the outer ladder apparatus longitudinal edges (the left edge as depicted), enabling ladder apparatus 10 to be swung at least 90° between an operable position (FIG. 1) and a stowed position (FIG. 2). Hinge assembly 28 is shown mounted relative to wall 11 through a two inch by ten inch nominal wooden base 32.

Figure 3:
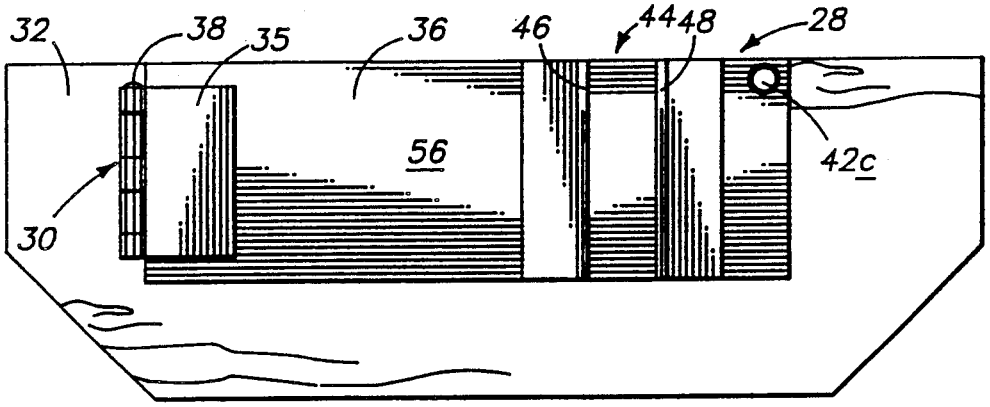
FIG. 3 is a front elevational view of a hinge assembly used in the ladder apparatus of FIG. 1 shown in a closed position, the ladder portion of the apparatus having been removed for clarity.
Figure 5:
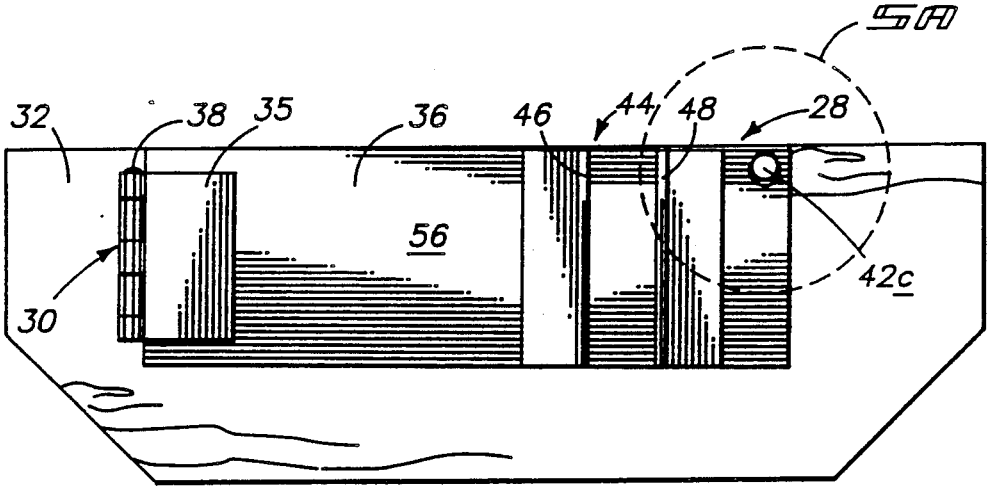
FIG. 5 is a front elevational view of the hinge plate of FIG. 3, shown in a downward tilted and retaining position.
Figure 4:
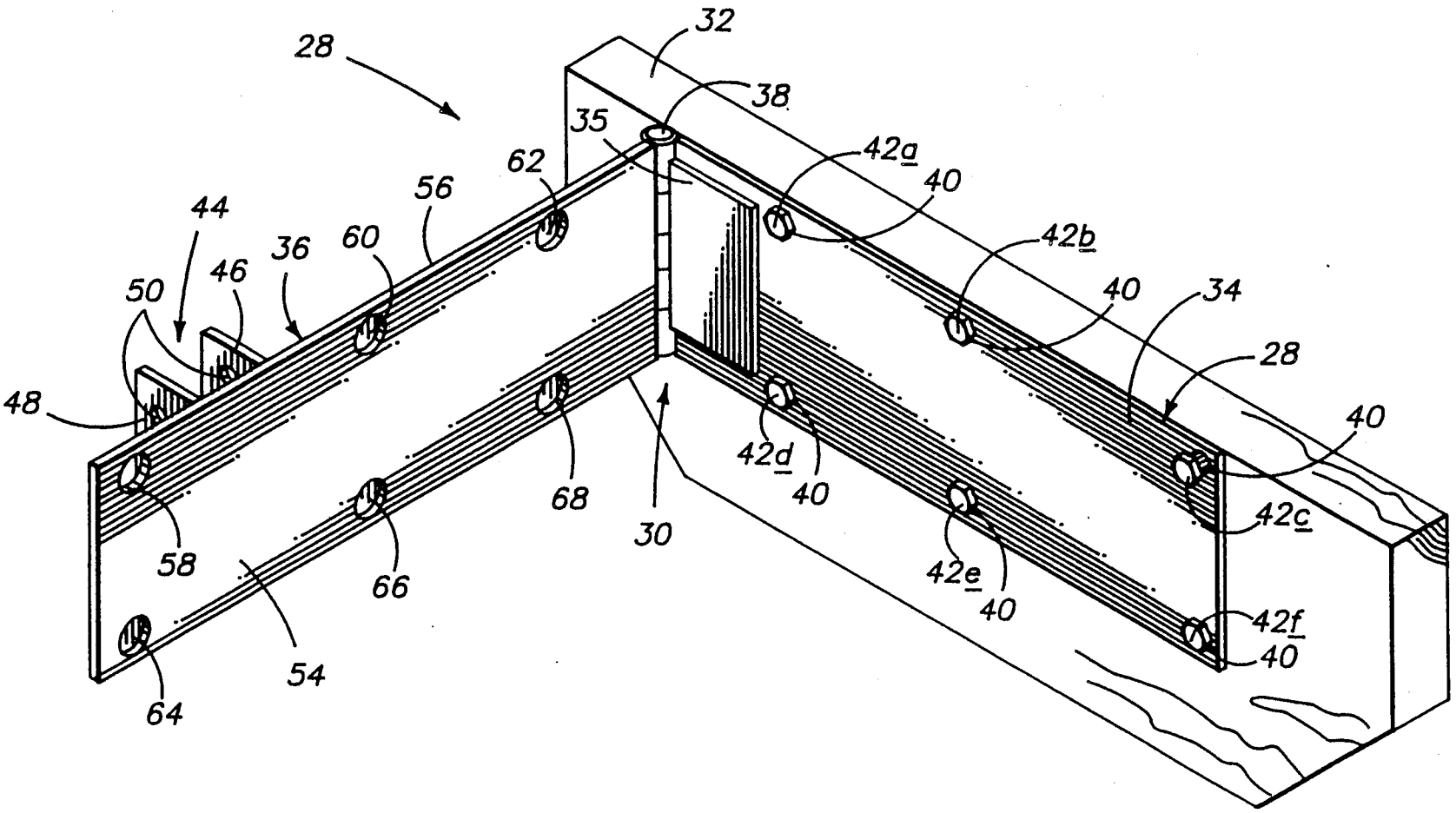
FIG. 4 is a perspective view of the FIG. 3 hinge assembly, shown in an open condition.

Referring more particularly to FIGS. 1–4, hinge assembly 28 is comprised of a pair of first and second interleaved hinge plates 34, 36 respectively. Each hinge plate is preferably comprised of two steel plates having dimensions of $16\frac{1}{4}''$ by $6''$ by $\frac{1}{4}''$. A hinge 35 is welded to each of plates 34 and 36. FIGS. 3 and 4 are enlarged views of hinge assembly 28 with central tread support 16 having been removed. First and second hinge plates 34, 36 are pivotally engaged relative to one another by an interconnecting pivot pin 38 (FIGS. 3–5).

First hinge plate 34 is adapted for mounting engagement relative to upper level 14 by means of a series of six mounting holes 40. Each of holes 40 receives one of lag screws 42*a*, 42*b*, 42*c*, 42*d*, 42*e* and 42*f*. The series of lag screws 42 secures first hinge plate 36 relative to mounting base 32, which is in turn suitably fastened to wall 11 by bolts, screws or some other suitable means (not shown). Alternatively, bolts 42 could be threaded directly into studs or other suitable anchors which comprise a part of wall 11.

Second hinge plate 36 includes means 44 for mounting second plate 36 to the elongated support 16. Means 44 is in the form of a pair of steel right angle mounting flanges 46, 48 which are welded to hinge plate 36 and extend therefrom as shown. As illustrated in FIGS. 1 and 2, each mounting flange 46, 48 engages one of the opposing sides of central tread support 16 adjacent its upper end 22. Each flange 46, 48 is provided with a pair of holes 50, 52, with the holes 50 of each bracket aligning with each other, and the holes 52 of each bracket aligning with each other. Corresponding holes are provided through elongated central support 16 (not visible in the drawings), with a bolt and nut combination (not shown) received through each of the aligned set of holes for securing central support 16 relative to second plate 36. As illustrated, hinge plates 34 and 36 are in juxtaposition with each other when in the operable position (FIG. 1).

Figure 6:
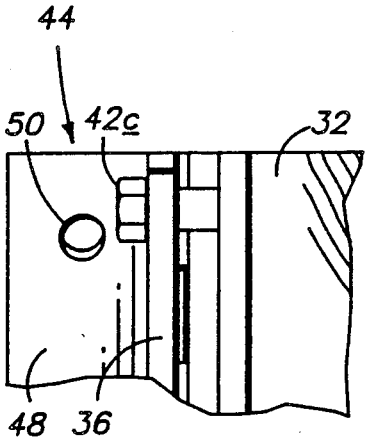
FIG. 6 is a side elevational view of FIG. 5A.
Figure 5A:
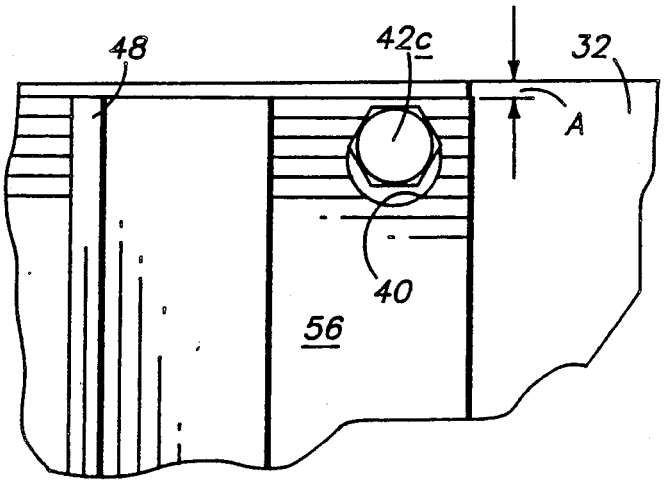
FIG. 5A is an enlarged view of the circle portion labeled "5A" in FIG. 5.

Retaining means are provided for inhibiting the ladder apparatus from swinging away from the operable position. A preferred retaining means is illustrated in FIGS. 5, 5A and 6. Specifically, the interleaved engagement of first hinge plate 34 and second hinge plate 36 by pivot pin 38 of hinge 35 provides limited angular free-play clearance between first and second plates 34, 36 respectively. For example, FIG. 3 illustrates hinge plate 34 and 36 being perfectly aligned and overlapping relative to one another. FIGS. 5, 5A and 6 illustrate second plate 36 being tilted downward angularly relative to first plate 34. Such is enabled as a result of the limited free-play clearance, or "slop", between pivot pin 38 and the interleaved portions of hinge 35, which form a part of plates 34 and 36. Such clearance is utilized for retaining second hinge plate 36 in juxtaposition with first hinge plate 34 in the following manner. A protrusion having a radial projection extends from first hinge plate 34 in the direction of second hinge plate 36. The radial projection is positioned for engagement by second hinge plate 36 upon a) downward tilting of second hinge plate 36 relative to first hinge plate 34, and b) any swinging movement of second hinge plate 36 away from first hinge plate 34 when in the juxtaposed, operable position.

More particularly, second hinge plate 36 is provided with an inner first hinge plate face 54 (FIG. 4) and an outer hinge plate face 56. First hinge plate face 54 includes a series of openings 58, 60, 62, 64, 66 and 68. Openings or recesses 60, 62, 64, 66 and 68 do not extend entirely through plate 36 from first face 54 to second face 56. Such openings merely provide recesses for receiving a respective head of the series of bolts/screws 42 to enable hinge plates 34 and 36 to be received in close juxtaposition relative to one another. The size of openings 60, 62, 64, 66 and 68 are large enough to receive the heads of screws 40 and yet allow limited free angular tilting movement of second plate 36 relative to first plate 34. Opening 58, on the other hand, extends from first face 54 to second face 56, and is sized and positioned to receive the head of screw 42*c* therethrough when second hinge plate 36 is in the illustrated operable, juxtaposed position. Screw 42*c* is threaded outwardly (alternately not initially threaded in to be tight) such that second face 56 of second hinge plate 36 will engage the underside or inner portion of the head of screw 42*c* upon a) downward tilting of second hinge plate 36 relative to first hinge plate 34, and b) swinging movement of second hinge plate 36 away from first hinge plate 34 when in the operable position. Such engagement is illustrated by FIGS. 5, 5A and 6. FIG. 4 illustrates that screw 42*c* is not threaded completely into base 32. In this manner, the protrusion of the illustrated embodiment comprises the bolt/screw 42*c*, with the radial projection comprising the enlarged head of bolt/screw 42*c*.

Typically, the mere mass or weight of hinge plate 36 and the remaining ladder apparatus components secured thereto will cause the illustrated downward tilting when plate 36 is moved even slightly from plate 34. The free-play clearance distance "A" (FIG. 5A) in the illustrated and described preferred embodiment is approximately $1/16''$.

Although the above-described preferred embodiment is described with reference to the alternating tread ladder apparatus of my U.S. Pat. No. 4,981,195 invention, it will be appreciated by the artisan that aspects of the ladder apparatus and hinge assembly would apply more broadly to other ladder apparatus.

In compliance with the statute, the invention has been described in language more or less specific as to structural and methodical features. It is to be understood, however, that the invention is not limited to the specific features shown and described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A ladder apparatus comprising:

a longitudinally elongated step support for mounting between an upper level and a lower level at a forward angle of inclination, the elongated support having an upper end and a lower end;

a series of steps mounted relative to the elongated support;

the ladder apparatus having opposing outer longitudinal edges; and a hinge assembly mounted relative to the elongated support adjacent its upper end, the hinge assembly including a pair of first and second interleaved hinge plates pivotally engaged relative to one another by an interconnecting pivot pin for swinging movement of the plates of at least about 90°, the first hinge plate including means for mounting engagement relative to the upper level, the second hinge plate including means for mounting the second plate to the elongated support, the pivot pin being oriented relative to the first and second hinge plates to be positioned adjacent one of the outer longitudinal edges when the second hinge plate is mounted relative to the elongated support to enable the ladder apparatus to be swung at least about 90° between an operable position and a stowed position, the first and second hinge plates being in juxtaposition with each other when the ladder apparatus is positioned in the operable position.

2. A ladder apparatus comprising:

a longitudinally elongated step support for mounting between an upper level and a lower level at a forward angle of inclination, the elongated support having an upper end and a lower end;

a series of steps mounted relative to the elongated support;

the ladder apparatus having opposing outer longitudinal edges; and a hinge assembly mounted relative to the elongated support adjacent its upper end, the hinge assembly including a pivot positioned adjacent one of the outer longitudinal edges enabling the ladder apparatus to be swung at least about 90° between an operable position and a stowed position;

wherein the hinge assembly comprises retaining means for inhibiting the ladder apparatus from swinging away from the operable position.

3. The ladder apparatus of claim 2 wherein, the hinge assembly comprises a pair of first and second interleaved hinge plates pivotally engaged relative to one another by an interconnecting pivot pin, the first hinge plate being adapted for mounting engagement relative to the upper level, the second hinge plate including means for mounting the second plate to the elongated support, the first hinge plate being mounted relative the second hinge plate for swinging movement of at least about 90° between the operable position and the stowed position, the first and second hinge plates being in juxtaposition with each other when in the operable position; and wherein the retaining means comprises:

the interleaved engagement of the first and second hinge plates by the pivot pin providing limited angular free-play clearance between the first and second plates, the limited free play clearance enabling limited angular tilting movement of the first and second hinge plates relative to one another; and a protrusion extending from the first hinge plate in the direction of the second hinge plate, the protrusion having a radial projection, the radial projection being positioned for engagement by the second hinge plate upon a) downward tilting of the second hinge plate relative to the first hinge plate, and b) swinging movement of the second hinge plate away from the first hinge plate when in the operable position.

4. The ladder apparatus of claim 3 wherein the protrusion comprises a bolt, the radial projection comprising an enlarged head of the bolt.

5. The ladder apparatus of claim 3 wherein the second hinge plate includes first and second faces, the second hinge plate further comprising an opening formed therein which extends from the first face to the second face, the opening being sized and positioned to receive the protrusion with its radial projection therethrough when the second hinge plate is in the operable position, the radial projection engaging the second hinge plate second face upon a) downward tilting of the second hinge plate relative to the first hinge plate, and b) swinging movement of the second hinge plate away from the first hinge plate when in the operable position.

6. The ladder apparatus of claim 5 wherein the protrusion comprises a bolt, the radial projection comprising an enlarged head of the bolt.

7. A ladder apparatus comprising:

a longitudinally elongated step support for mounting between an upper level and a lower level at a forward angle of inclination, the elongated support having an upper end and a lower end;

a series of steps mounted relative to the elongated support;

the ladder apparatus having opposing outer longitudinal edges; and a hinge assembly mounted relative to the elongated support adjacent its upper end, the hinge assembly including a pivot positioned adjacent one of the outer longitudinal edges enabling the ladder apparatus to be swung at least about 90° between an operable position and a stowed position;

wherein the upper end of the elongated step support includes opposing sides; and the hinge assembly includes a pair of mounting flanges extending therefrom, each of the mounting flanges engaging one of the opposing sides.

8. A ladder apparatus comprising:

a longitudinally elongated step support for mounting between an upper level and a lower level at a forward angle of inclination, the elongated support having an upper end and a lower end;

a series of steps mounted relative to the elongated support;

the ladder apparatus having opposing outer longitudinal edges; and a hinge assembly mounted relative to the elongated support adjacent its upper end, the hinge assembly including a pivot positioned adjacent one of the outer longitudinal edges enabling the ladder apparatus to be swung at least about 90° between an operable position and a stowed position;

wherein the hinge assembly comprises retaining means for inhibiting the ladder apparatus from swinging away from the operable position; and wherein the upper end of the elongated step support includes opposing sides; and the hinge assembly includes a pair of mounting flanges extending therefrom, each of the mounting flanges engaging one of the opposing sides.

9. The ladder apparatus of claim 8 wherein, the hinge assembly comprises a pair of first and second interleaved hinge plates pivotally engaged relative to one another by an interconnecting pivot pin, the first hinge plate being adapted for mounting engagement relative to the upper level, the second hinge plate including means for mounting the second plate to the elongated support, the first hinge plate being mounted relative the second hinge plate for swinging movement of at least about 90° between the operable position and the stowed position, the first and second hinge plates being in juxtaposition with each other when in the operable position; and wherein the retaining means comprises:

the interleaved engagement of the first and second hinge plates by the pivot pin providing limited angular free-play clearance between the first and second plates, the limited free play clearance enabling limited angular tilting movement of the first and second hinge plates relative to one another; and a protrusion extending from the first hinge plate in the direction of the second hinge plate, the protrusion having a radial projection, the radial projection being positioned for engagement by the second hinge plate upon a) downward tilting of the second hinge plate relative to the first hinge plate, and b) swinging movement of the second hinge plate away from the first hinge plate when in the operable position.

10. The ladder apparatus of claim 9 wherein the protrusion comprises a bolt, the radial projection comprising an enlarged head of the bolt.

11. The ladder apparatus of claim 9 wherein the second hinge plate includes first and second faces, the second hinge plate further comprising an opening formed therein which extends from the first face to the second face, the opening being sized and positioned to receive the protrusion with its radial projection therethrough when the second hinge plate is in the operable position, the radial projection engaging the second hinge plate second face upon a) downward tilting of the second hinge plate relative to the first hinge plate, and b) swinging movement of the second hinge plate away from the first hinge plate when in the operable position.

12. The ladder apparatus of claim 11 wherein the protrusion comprises a bolt, the radial projection comprising an enlarged head of the bolt.

13. An alternating tread ladder apparatus comprising:

a central longitudinally elongated tread support for mounting between an upper level and a lower level at a forward angle of inclination, the elongated support having an upper end and a lower end, and having opposing sides;

a series of alternating tread steps mounted relative to the opposing sides of the elongated central support, the tread steps at least in part defining opposing outer longitudinal ladder apparatus edges; and a hinge assembly mounted relative to the elongated support adjacent its upper end, the hinge assembly including a pair of first and second interleaved hinge plates pivotally engaged relative to one another by an interconnecting pivot pin for swinging movement of the plates of at least about 90°, the first hinge plate including means for mounting engagement relative to the upper level, the second hinge plate including means for mounting the second plate to the elongated support, the pivot pin being oriented relative to the first and second hinge plates to be positioned adjacent one of the outer longitudinal edges when the second hinge plate is mounted relative to the elongated support to enable the ladder apparatus to be swung at least about 90° between an operable position and a stowed position, the first and second hinge plates being in juxtaposition with each other when the ladder apparatus is positioned in the operable position.

14. An alternating tread ladder apparatus comprising:

a central longitudinally elongated tread support for mounting between an upper level and a lower level at a forward angle of inclination, the elongated support having an upper end and a lower end, and having opposing sides;

a series of alternating tread steps mounted relative to the opposing sides of the elongated central support, the tread steps at least in part defining opposing outer longitudinal ladder apparatus edges; and a hinge assembly mounted relative to the elongated support adjacent its upper end, the hinge assembly including a pivot positioned adjacent one of the outer longitudinal edges enabling the ladder apparatus to be swung at least about 90° between an operable position and a stowed position;

wherein the hinge assembly comprises retaining means for inhibiting the ladder apparatus from swinging away from the operable position.

15. The alternating tread ladder apparatus of claim 14 wherein, the hinge assembly comprises a pair of first and second interleaved hinge plates pivotally engaged relative to one another by an interconnecting pivot pin, the first hinge plate being adapted for mounting engagement relative to the upper level, the second hinge plate including means for mounting the second plate to the elongated support, the first hinge plate being mounted relative the second hinge plate for swinging movement of at least about 90° between the operable position and the stowed position, the first and second hinge plates being in juxtaposition with each other when in the operable position; and wherein the retaining means comprises:

the interleaved engagement of the first and second hinge plates by the pivot pin providing limited angular free-play clearance between the first and second plates, the limited free play clearance enabling limited angular tilting movement of the first and second hinge plates relative to one another; and a protrusion extending from the first hinge plate in the direction of the second hinge plate, the protrusion having a radial projection, the radial projection being positioned for engagement by the second hinge plate upon a) downward tilting of the second hinge plate relative to the first hinge plate, and b) swinging movement of the second hinge plate away from the first hinge plate when in the operable position.

16. The alternating tread ladder apparatus of claim 15 wherein the protrusion comprises a bolt, the radial projection comprising an enlarged head of the bolt.

17. The alternating tread ladder apparatus of claim 15 wherein the second hinge plate includes first and second faces, the second hinge plate further comprising an opening formed therein which extends from the first face to the second face, the opening being sized and positioned to receive the protrusion with its radial projection therethrough when the second hinge plate is in the operable position, the radial projection engaging the second hinge plate second face upon a) downward tilting of the second hinge plate relative to the first hinge plate, and b) swinging movement of the second hinge plate away from the first hinge plate when in the operable position.

18. The alternating tread ladder apparatus of claim 17 wherein the protrusion comprises a bolt, the radial projection comprising an enlarged head of the bolt.

19. An alternating tread ladder apparatus comprising:

a central longitudinally elongated tread support for mounting between an upper level at a lower level at a forward angle of inclination, the elongated support having an upper end and a lower end, and having opposing sides;

a series of alternating tread steps mounted relative to the opposing sides of the elongated central support, the tread steps at least in part defining opposing outer longitudinal ladder apparatus edges; and a hinge assembly mounted relative to the elongated support adjacent its upper end, the hinge assembly including a pivot positioned adjacent one of the outer longitudinal edges enabling the ladder apparatus to be swung at least about 90° between an operable position and a stowed position;

wherein the hinge assembly includes a pair of mounting flanges extending therefrom, each of the mounting flanges engaging one of the opposing sides of the tread support adjacent its upper end.

20. An alternating tread ladder apparatus comprising:

a central longitudinally elongated tread support for mounting between an upper level and a lower level at a forward angle of inclination, the elongated support having an upper end and a lower end, and having opposing sides;

a series of alternating tread steps mounted relative to the opposing sides of the elongated central support, the tread steps at least in part defining opposing outer longitudinal ladder apparatus edges; and a hinge assembly mounted relative to the elongated support adjacent its upper end, the hinge assembly including a pivot positioned adjacent one of the outer longitudinal edges enabling the ladder apparatus to be swung at least about 90° between an operable position and a stowed position:

wherein the hinge assembly comprises retaining means for inhibiting the ladder apparatus from swinging away from the operable position; and wherein the hinge assembly includes a pair of mounting flanges extending therefrom, each of the mounting flanges engaging one of the opposing sides of the tread support adjacent its upper end.

21. The alternating tread ladder apparatus of claim 20 wherein, the hinge assembly comprises a pair of first and second interleaved hinge plates pivotally engaged relative to one another by an interconnecting pivot pin, the first hinge plate being adapted for mounting engagement relative to the upper level, the second hinge plate including means for mounting the second plate to the elongated support, the first hinge plate being mounted relative the second hinge plate for swinging movement of at least about 90° between the operable position and the stowed position, the first and second hinge plates being in juxtaposition with each other when in the operable position; and wherein the retaining means comprises:

the interleaved engagement of the first and second hinge plates by the pivot pin providing limited angular free-play clearance between the first and second plates, the limited free play clearance enabling limited angular tilting movement of the first and second hinge plates relative to one another; and a protrusion extending from the first hinge plate in the direction of the second hinge plate, the protrusion having a radial projection, the radial projection being positioned for engagement by the second hinge plate upon a) downward tilting of the second hinge plate relative to the first hinge plate, and b) swinging movement of the second hinge plate away from the first hinge plate when in the operable position.

22. The alternating tread ladder apparatus of claim 21 wherein the protrusion comprises a bolt, the radial projection comprising an enlarged head of the bolt.

23. The alternating tread ladder apparatus of claim 21 wherein the second hinge plate includes first and second faces, the second hinge plate further comprising an opening formed therein which extends from the first face to the second face, the opening being sized and positioned to receive the protrusion with its radial projection therethrough when the second hinge plate is in the operable position, the radial projection engaging the second hinge plate second face upon a) downward tilting of the second hinge plate relative to the first hinge plate, and b) swinging movement of the second hinge plate away from the first hinge plate when in the operable position.

24. The alternating tread ladder apparatus of claim 23 wherein the protrusion comprises a bolt, the radial projection comprising an enlarged head of the bolt.

25. For a ladder apparatus having a longitudinally elongated step support for mounting between an upper level and a lower level at a forward angle of inclination, the elongated support having an upper end and a lower end, the ladder apparatus having a series of steps mounted relative to the elongated support, the ladder apparatus having opposing outer longitudinal edges, a hinge assembly comprising:

a pair of first and second interleaved hinge plates pivotally engaged relative to one another by an interconnecting pivot pin for swinging movement of the plates of at least about 90°, the first hinge plate including means for mounting engagement relative to the upper level, the second hinge plate including means for mounting the second plate to the elongated support, the pivot pin being oriented relative to the first and second plates to be positioned adjacent one of the outer longitudinal ladder apparatus edges when the second hinge plate is mounted relative to the elongated support to enable swinging movement of the ladder apparatus of at least about 90° between an operable ladder apparatus position and a stowed ladder apparatus position, the first and second hinge plates being in juxtaposition with each other when a ladder apparatus is mounted thereto and positioned in the operable position.

26. The hinge assembly of claim 25 further comprising retaining means for inhibiting the swinging of the first and second hinge plates from one another when in the operable position.

27. The hinge assembly of claim 26 wherein the retaining means comprises:

the interleaved engagement of the first and second hinge plates by the pivot pin providing limited angular free-play clearance between the first and second plates, the limited free play clearance enabling limited angular tilting movement of the first and second hinge plates relative to one another; and a protrusion extending from the first hinge plate in the direction of the second hinge plate, the protrusion having a radial projection, the radial projection being positioned for engagement by the second hinge plate upon a) downward tilting of the second hinge plate relative to the first hinge plate, and b) swinging movement of the second hinge plate away from the first hinge plate when in the operable position.

28. The hinge assembly of claim 27 wherein the second hinge plate includes first and second faces, the second hinge plate further comprising an opening formed therein which extends from the first face to the second face, the opening being sized and positioned to receive the protrusion with its radial projection therethrough when the second hinge plate is in the operable position, the radial projection engaging the second hinge plate second face upon a) downward tilting of the second hinge plate relative to the first hinge plate, and b) swinging movement of the second hinge plate away from the first hinge plate when in the operable position.

29. The hinge assembly of claim 28 wherein the protrusion comprises a bolt, the radial projection comprising an enlarged head of the bolt.

30. The hinge assembly of claim 28 wherein the means for mounting the second plate to the elongated support comprises a pair of mounting flanges extending from the second plate, the mounting flanges being positioned to engage opposing sides of the elongated support.

31. The hinge assembly of claim 28 wherein the means for mounting the second plate to the elongated support comprises a pair of mounting flanges extending from the second plate, the mounting flanges being positioned to engage opposing sides of the elongated support; the hinge assembly further comprising retaining means for inhibiting the swinging of the first and second hinge plates from one another when in the operable position.

32. The hinge assembly of claim 31 wherein the retaining means comprises:

the interleaved engagement of the first and second hinge plates by the pivot pin providing limited angular free-play clearance between the first and second plates, the limited free play clearance enabling limited angular tilting movement of the first and second hinge plates relative to one another; and a protrusion extending from the first hinge plate in the direction of the second hinge plate, the protrusion having a radial projection, the radial projection being positioned for engagement by the second hinge plate upon a) downward tilting of the second hinge plate relative to the first hinge plate, and b) swinging movement of the second hinge plate away from the first hinge plate when in the operable position.

33. The hinge assembly of claim 32 wherein the second hinge plate includes first and second faces, the second hinge plate further comprising an opening formed therein which extends from the first face to the second face, the opening being sized and positioned to receive the protrusion with its radial projection therethrough when the second hinge plate is in the operable position, the radial projection engaging the second hinge plate second face upon a) downward tilting of the second hinge plate relative to the first hinge plate, and b) swinging movement of the second hinge plate away from the first hinge plate when in the operable position.

34. The ladder apparatus of claim 1 wherein the interleaved engagement of the first and second hinge plates by the pivot pin provides limited angular free-play clearance between the first and second plates, the limited free-play clearance enabling limited angular tilting movement of the first and second hinge plates relative to one another, the hinge assembly further comprising:

a protrusion extending from the first hinge plate in the direction of the second hinge plate, the protrusion being positioned for engagement by the second hinge plate upon downward movement of the second hinge plate relative to the first hinge plate when the ladder apparatus is positioned in the operable position.

35. The ladder apparatus of claim 34 wherein the second hinge plate includes first and second faces, the second hinge plate further comprising an opening formed therein which extends from the first face to the second face, the opening being sized and positioned to receive the protrusion therethrough when the second hinge plate is in the operable position, the protrusion extending through the opening when the ladder apparatus is positioned in the operable position.

36. The ladder apparatus of claim 13 wherein the interleaved engagement of the first and second hinge plates by the pivot pin provides limited angular free-play clearance between the first and second plates, the limited free-play clearance enabling limited angular tilting movement of the first and second hinge plates relative to one another, the hinge assembly further comprising:

a protrusion extending from the first hinge plate in the direction of the second hinge plate, the protrusion being positioned for engagement by the second hinge plate upon downward movement of the second hinge plate relative to the first hinge plate when the ladder apparatus is positioned in the operable position.

37. The ladder apparatus of claim 36 wherein the second hinge plate includes first and second faces, the second hinge plate further comprising an opening formed therein which extends from the first face to the second face, the opening being sized and positioned to receive the protrusion therethrough when the second hinge plate is in the operable position, the protrusion extending through the opening when the ladder apparatus is positioned in the operable position.

38. The hinge assembly of claim 25 wherein the interleaved engagement of the first and second hinge plates by the pivot pin provides limited angular free-play clearance between the first and second plates, the limited free-play clearance enabling limited angular tilting movement of the first and second hinge plates relative to one another, the hinge assembly further comprising:

a protrusion extending from the first hinge plate in the direction of the second hinge plate, the protrusion being positioned for engagement by the second hinge plate upon downward movement of the second hinge plate relative to the first hinge plate when the ladder apparatus is positioned in the operable position.

39. The hinge assembly of claim 38 wherein the second hinge plate includes first and second faces, the second hinge plate further comprising an opening formed therein which extends from the first face to the second face, the opening being sized and positioned to receive the protrusion therethrough when the second hinge plate is in the operable position, the protrusion extending through the opening when the ladder apparatus is positioned in the operable position.

* * * * *